US009050245B2

(12) United States Patent
Beavers

(10) Patent No.: US 9,050,245 B2
(45) Date of Patent: Jun. 9, 2015

(54) TEETHING DEVICE

(71) Applicant: Donna Marie Beavers, Cedar Park, TX (US)

(72) Inventor: Donna Marie Beavers, Cedar Park, TX (US)

(73) Assignee: Donna Marie Beavers, Cedar Park, TX (US)

( * ) Notice: Subject to any disclaimer, the term of this patent is extended or adjusted under 35 U.S.C. 154(b) by 0 days.

(21) Appl. No.: 14/065,509

(22) Filed: Oct. 29, 2013

(65) Prior Publication Data

US 2014/0135836 A1 May 15, 2014

Related U.S. Application Data

(60) Provisional application No. 61/725,407, filed on Nov. 12, 2012.

(51) Int. Cl.

| | |
|---|---|
| ***A61J 17/00*** | (2006.01) |
| ***A61J 17/02*** | (2006.01) |
| *A61H 13/00* | (2006.01) |

(52) U.S. Cl.

CPC ..... *A61J 17/02* (2013.01); *A61J 2017/007* (2013.01); *A61H 13/00* (2013.01); *A61J 17/00* (2013.01)

(58) Field of Classification Search

CPC ..... A61J 17/00; A61J 2017/007; A61H 13/00
USPC ..... 606/234, 235; 36/112, 72 R, 111, 136; 2/39, 240, 239, 22, 61, 241, 242, 75, 2/80; 273/440; 441/64; 119/709, 710
See application file for complete search history.

(56) References Cited

U.S. PATENT DOCUMENTS

| | | | | |
|---|---|---|---|---|
| 1,537,811 | A | 5/1925 | Epling | |
| 3,017,640 | A * | 1/1962 | Mintaetta et al. | 2/239 |
| 3,023,420 | A * | 3/1962 | Tann | 2/239 |
| 3,242,597 | A * | 3/1966 | Ermond et al. | 36/72 R |
| 4,295,647 | A * | 10/1981 | Daly | 273/440 |
| 4,823,426 | A * | 4/1989 | Bragga | 15/210.1 |
| 5,385,573 | A | 1/1995 | Wright | |
| D357,746 | S | 4/1995 | Sofia | |
| 5,830,035 | A * | 11/1998 | Budreck | 446/366 |
| 5,979,085 | A * | 11/1999 | Ross et al. | 36/136 |
| 5,993,285 | A | 11/1999 | Sofia et al. | |
| 6,247,982 | B1 * | 6/2001 | Walker | 441/64 |
| 6,475,051 | B1 * | 11/2002 | Griffin et al. | 446/26 |
| 7,000,337 | B2 * | 2/2006 | Harrington | 36/132 |
| 7,237,347 | B2 * | 7/2007 | Tobias | 36/112 |
| 7,470,164 | B2 * | 12/2008 | Moyal | 441/64 |
| D645,969 | S | 9/2011 | Del Solar et al. | |
| 2005/0210652 | A1 | 9/2005 | Epstein | |
| 2005/0222621 | A1 | 10/2005 | Duwlius et al. | |
| 2006/0004412 | A1 | 1/2006 | Gilbert, Jr. | |
| 2007/0288056 | A1 | 12/2007 | Goldwire | |
| 2009/0143822 | A1 | 6/2009 | Perry | |
| 2009/0163952 | A1 | 6/2009 | Kash | |
| 2010/0095434 | A1 * | 4/2010 | Stuart | 2/240 |
| 2012/0016416 | A1 | 1/2012 | Frazier | |

* cited by examiner

*Primary Examiner* — Todd Manahan
*Assistant Examiner* — Majid Jamialahmadi
(74) *Attorney, Agent, or Firm* — Pierson IP, PLLC

(57) ABSTRACT

Embodiments of systems and methods for a teething device for an article of clothing configured to cover a foot with toes. The teething device includes a teether that is coupled to an outer surface of the article of clothing and extends in a direction parallel to the toes.

8 Claims, 8 Drawing Sheets

800

TEETHING DEVICE

CROSS-REFERENCE TO RELATED APPLICATIONS

This application claims a benefit of priority under 35 U.S.C. §119 to Provisional Application No. 61/725,407, filed on Nov. 12, 2012, entitled "TEETHING DEVICE" which is fully incorporated by reference in its entirety.

TECHNICAL FIELD

This disclosure relates generally to systems and methods for a teething device. Specifically, this disclosure relates to systems and methods for a teething device coupled to an article of clothing covering an infant's foot.

BACKGROUND

Teething is the process by which an infant's teeth emerge through the gums. Conventionally, teething devices are made of materials that an infant may chew on that allow the infant to break down the gum tissue surrounding the emerging teeth.

An infant may begin teething as young as three months old, and teething may continue for several years. The pain associated with teething may be severe for an infant and may interfere with the infant's sleep cycle or overall level of comfort.

The use of traditional teething devices that attach to an infant's hand or wrist may be inefficient or otherwise less than desirable because infants may not have developed sufficient hand-eye coordination to guide the teething device from the infant's hand to the infant's mouth. Further, infants are prone to drop, throw, or remove teething devices coupled to their hand, fingers, or wrist because infants desire to have their hands and fingers unobstructed. Thus, teething devices may be lost or dropped onto unclean or otherwise undesirable surfaces.

Accordingly, needs exist for teething devices that may be coupled to an article of clothing covering an infant's foot or toes.

SUMMARY

Embodiments described herein relate to a teething device that may be coupled to an article of clothing that is configured to cover an infant's foot or toes.

As the teething process for an infant begins, it may be desired for the infant to have immediate access to a teething device. However, infants are prone to spit out, throw, or drop teething devices that are not attached to an article of the infant's clothing or another nearby surface. Infants naturally desire to nibble, chew, or bite their toes. However, if an infant were to suck on their toes through a conventional sock, the sock may become moist or ripped.

To this end, embodiments disclosed herein provide systems and methods for a teething device being coupled to an article of clothing covering an infant's foot. As such, an infant may use the teething device via a natural action of the infant nibbling on his or her toes. More specifically, the teething device may include a teether coupled across a surface of an article of clothing covering the infant's foot, without protruding into the article of clothing, so that the infant does not need to grasp a hold of the teething device. Further, because the teether does not extend into an inner surface or the interior of the article of clothing there is no need to form an additional hole in the article of clothing and the infant may wear the article of clothing without having their foot contact the teether.

In one embodiment, a teething device may include an article of clothing configured to cover a foot with toes and a teether configured to couple to an outer surface of the article of clothing and extend in a direction perpendicular to the toes.

In a further embodiment, the teether may be configured to be coupled to the outer surface of the article of clothing without forming a passage to an inner surface of the article of clothing. By the teether not extending into an inner surface of the article of clothing, the teether may remain sanitary without contacting the infant's foot.

In a further embodiment, the article of clothing is one of a sock, footee, or bootee.

In a further embodiment, the teether is configured to be coupled to the article of clothing across the tip of the toes, extend in a direction outward from the toes, and rotate from a first position to a second position. In the first position, the teether is in the direction outward from the toes. In the second position, the teether is disposed on top of the toes.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions, or rearrangements may be made within the scope of the invention. The invention includes all such substitutions, modifications, additions or rearrangements.

BRIEF DESCRIPTION OF THE DRAWINGS

The drawings accompanying and forming part of this specification are included to depict certain aspects of the invention. A clearer impression of the invention, and of the components and operation of systems provided with the invention, will become more readily apparent by referring to the exemplary, and therefore nonlimiting, embodiments illustrated in the drawings, wherein identical reference numerals designate the same components. Note that the features illustrated in the drawings are not necessarily drawn to scale.

DETAILED DESCRIPTION

The invention and the various features and advantageous details thereof are explained more fully with reference to the nonlimiting embodiments that are illustrated in the accompanying drawings and are detailed in the following description.

Descriptions of well-known starting materials, processing techniques, components, and equipment are omitted so as not to unnecessarily obscure the invention in detail.

It should be understood, however, that the detailed description and the specific examples, while indicating preferred embodiments of the invention, are given by way of illustration only and not by way of limitation. Various substitutions, modifications, additions and/or rearrangements within the spirit and/or scope of the underlying inventive concept will become apparent to those skilled in the art from this disclosure.

As used herein, the terms "comprises," "comprising," "includes," "including," "has," "having," or any other variation thereof, are intended to cover a non-exclusive inclusion. For example, a process, article, or apparatus that comprises a list of elements is not necessarily limited to only those elements but may include other elements not expressly listed or inherent to such process, article, or apparatus.

Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

Additionally, any examples or illustrations given herein are not to be regarded in any way as restrictions on, limits to, or express definitions of any term or terms with which they are utilized. Instead, these examples or illustrations are to be regarded as being described with respect to one particular embodiment and as being illustrative only. Those of ordinary skill in the art will appreciate that any term or terms with which these examples or illustrations are utilized will encompass other embodiments which may or may not be given therewith or elsewhere in the specification and all such embodiments are intended to be included within the scope of that term or terms. Language designating such nonlimiting examples and illustrations includes, but is not limited to: "for example," "for instance," "e.g.," and "in one embodiment."

Figure 1:
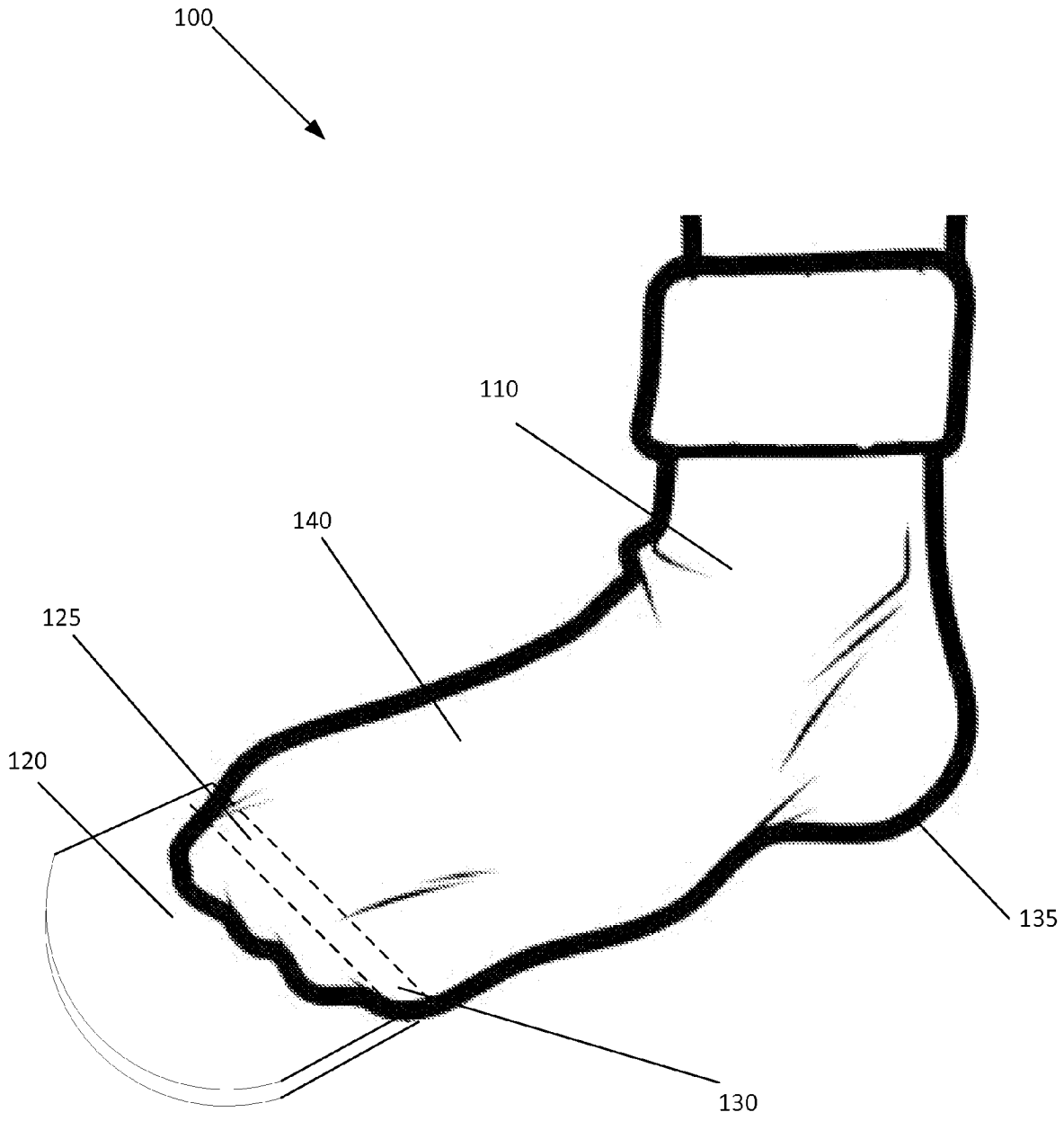
FIG. 1 depicts one embodiment of a teething device.

FIG. 1 depicts one embodiment of a teething device 100. Teething device 100 may include an article of clothing 110 configured to cover an infant's foot and toes, teether 120, and coupling device 130.

Article of clothing 110 may be any type of fabric such as a sock, foot wrap, garment, bootee, footees, fabric, etc. configured to cover an infant's foot and toes (for the sake of brevity, the article of clothing covering an infant's foot may be referred to hereinafter as a "sock 110"). Sock 110 may be comprised of a wide variety of materials including cotton, wool, nylon, acrylic, etc., and may be manufactured in a variety of lengths which may extend above or below an ankle or knee of an infant.

Sock 110 may be worn on the infant's foot for protection and warmth. By sock 110 being configured to be worn over an infant's foot, the infant's hands and fingers may not be obstructed while wearing sock 110. Sock 110 may be manufactured in a variety of styles such as standard socks or toe socks, where each toe is encased in a respective compartment.

Teether 120 may be any object designed for a baby to bite, chew, and/or suck on during teething. Teether 120 may be comprised of any known materials that are safe for an infant to use during teething such as rubber, silicone, phthalate-free PVC, plastics, woods, fabrics, etc. Teether 120 may be designed of any shape or size such as a semi-circle, rectangular, square, triangle, sphere, cylinder, shaped like a toy, etc. Teether 120 may comprise various types of textures such as bumps, ridges, projections, indentations, etc. In embodiments, teether 120 may be removably coupled to or permanently coupled to sock 110.

In one embodiment, teether 120 may be configured to be coupled to and extend across at least one of an infant's toes, a plurality of, all of the toes on an infant's foot, and/or across the surface of the infant's foot. In one embodiment, teether 120 may be configured to extend from a first position close to the infant's ankles towards a second position in close proximity to or on the infant's toes. In another embodiment, teether 120 may be configured to be disposed on a diagonal position across a top portion 140 of the infant's foot.

Teether coupling member 125 may be positioned on one side of teether 120, along an entire side of teether 120, have a plurality of connection points along a side of teether 120, etc. In one embodiment, Teether coupling member 125 may be configured to be received by sock coupling member 130 on a surface of sock 110 without extending into a surface of sock 110 or forming a hole in sock 110.

Sock coupling member 130 may be positioned at any location on a surface of sock 110. For example, sock coupling member 130 may be disposed at a position on the surface of sock 110 associated with the tips of the infant's toes, across an infant's toe, across a plurality of the infant's toes, across a top portion of the infant's foot, across any portion of the infant's ankle, on the side of the infant's foot, etc. For example, in one embodiment sock coupling member 130 may be positioned at the tip of at least one of the infant's toes to couple teether 120 to sock 110 at the tip of at least one of the infant's toes.

Sock coupling member 130 may be configured to receive teether coupling member 125 to either fixedly or removably couple sock 110 and teether 120, so that neither teether 120 nor teether coupling member 125 extend into an inner surface of sock 110, extend into an interior of sock 110, or form a hole in sock 110.

One skilled in the art will appreciate that either teether coupling member 125 or sock coupling member 130 may be the female or male components to couple the elements together. Coupling members 125, 130 may be configured to extend across a surface of sock 110 and be parallel, diagonal or perpendicular to at least one of the infant's toes. In one embodiment, coupling members 125, 130 may be configured to extend across one, a plurality, or all of the infant's toes.

Teether coupling member 125 may be configured to be coupled to sock coupling member 130 so that teether 120 may rotate or swivel on a hinged position from the heel of the infant's foot 135 to a top portion of the infant's foot 140. In another embodiment, teether 120 may be configured to project outward in slightly upward fashion with respect to the infant's toes and rotate upward toward the top portion of the infant's foot 140. Therefore, if teether 120 is configured to be disposed at an upward angle with respect to the infant's toes or a surface of a floor, teether 120 may not touch the surface of the floor. In another embodiment, teether 120 may be coupled to sock 130 in a rigid position at an upward angle or in a straight position, and may be unable to rotate or swivel.

Teether 120 may be configured to be fixed to sock 110 via teether coupling member 125 and sock coupling member 130. Teether 120 may be coupled to sock 110 by being sewn together, coupled via elastic, or fixed together via any known mechanism. Teether 120 may be fixedly attached to sock 110 so that an infant can always access teether 120 while wearing sock 110.

Teether coupling member 125 and sock coupling member 130 may also be used to temporarily couple teether 120 to sock 110. Teether coupling member 125 and sock coupling member 130 may couple together via snaps, a hoop and lock mechanism such as Velcro, a zipper, button(s), buckle(s), clip(s), etc. In other embodiments, teether coupling member 125 and sock coupling member 130 may be permanently bonded together, such that teether 120 is permanently fixed to sock 110.

When teether coupling member 125 is coupled and uncoupled to sock coupling member 130 there will not be any additional orifices, openings or holes in sock 110. Therefore, if teether 120 is coupled to sock 110 an infant may not be required to grasp or hold teether 120. Nor will teether 120 obstruct the infant's natural use of his/her toes within sock 110. Further, sock 110 may function like a sock to provide protection and warmth to the infant's foot and/or toes without having any uncovered surface of the infant's foot and/or toes.

By having teether 120 temporarily coupled to sock 110, one may uncouple teether 120 from sock 110. When teether 120 is uncoupled from sock 110, teether 120 may be cleaned, stored away, etc.

Further, one skilled in the art will appreciate that that in other embodiments, a plurality of teethers may be coupled to sock 110 via a plurality of teether coupling members 125 via respective sock coupling members 130. Therefore, an infant may have access to a plurality of teethers via sock 110.

Figure 2:
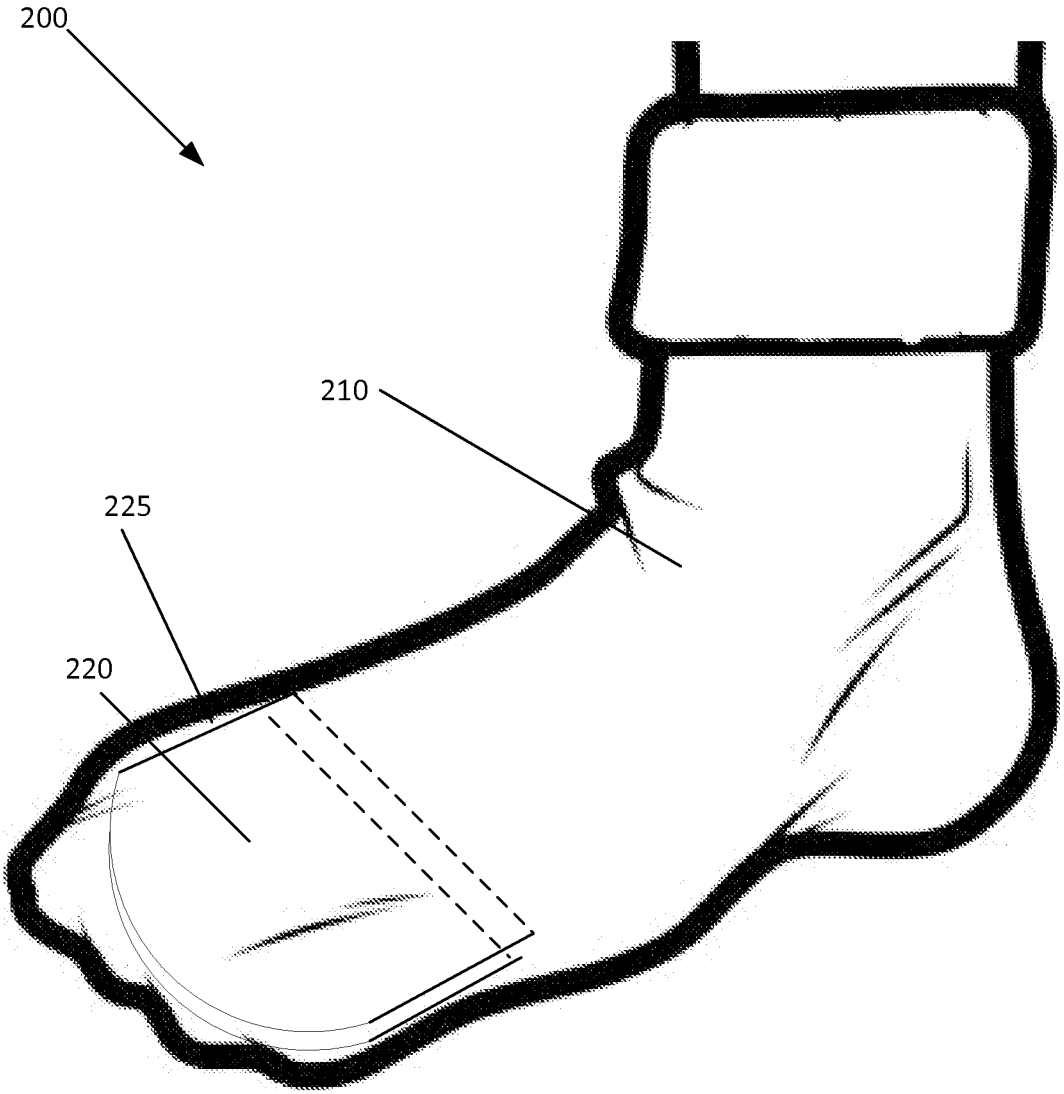
FIG. 2 depicts one embodiment of a teething device.

FIG. 2 depicts one embodiment of a teething device 200. Certain elements of teething device 200 are substantially the same as teething device 100, therefore for the sake of brevity another description of these elements is omitted.

Teether 220 may be configured to be coupled to sock 210 along a top portion 225 of an infant's foot, across the infant's toes. Specifically, teether 220 may be coupled from a first position on top portion 225 of an infant's foot, extend across a surface of the infants toes, to a second position on top portion 225 of the infant's toes. Teether 220 may be aligned across top portion 225 of the infant's toes, such that if the infant brings the infant's toes to their mouth, then teether 220 may be aligned with their toes, which may simulate an action of the infant inserting the infant's toes into the infant's mouth.

In this embodiment, teether 220 may be configured to be fixedly or removably coupled to sock 210 via any known mechanism so teether 220 may rotate in a direction perpendicular to the infant's toes. In a first position, teether 220 may be extended on top of the infant's toes in the same direction as the toes, and in a second position teether 220 may be rotated away from the infant's toes and extend towards the infant's ankle. In one embodiment, teether 220 may be configured to substantially cover or entirely cover the infant's toes if teether 220 is in the first position.

Teether 220 may be configured to be disposed on a top surface 225 of the infant's foot so that teether 220 does not touch a surface of a floor when teether 220 is not being used as a teether by the infant. Teether 220 may also rotate towards the infant's toes and ankles so the infant may have better access to teether 220.

Figure 3:
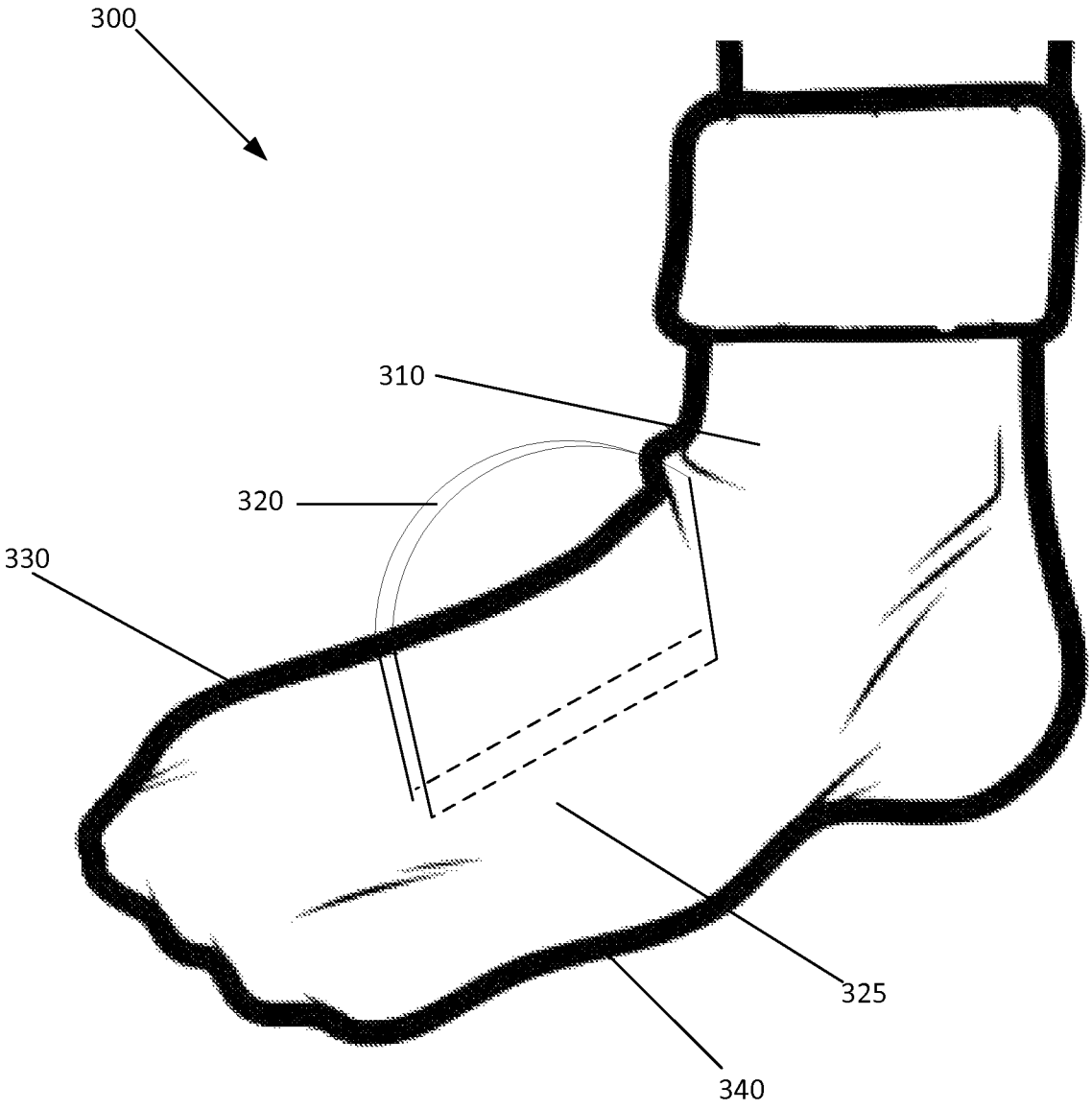
FIG. 3 depicts one embodiment of a teething device.

FIG. 3 depicts one embodiment of a teething device 300. Certain elements of teething device 300 are substantially the same as teething device 100, therefore for the sake of brevity another description of these elements is omitted.

Teether 320 may be configured to be coupled to sock 310 along a top portion 325 of an infant's foot in a direction from the infant's toes towards the infant's ankle. In one embodiment, teether 320 may be of any width, and may extend from the end of the infant's toes towards the infants ankle or may be any smaller sized width.

In an embodiment, teether 320 may be configured to be fixedly or removably coupled to sock 310 via any known mechanism configured to allow teether 320 to be rotated from a first side of the infant's foot 330 to a second side of the infant's foot 340. In a first position, teether 320 may be extended towards the first side of the infant's foot 330, and in the second position, teether 320 may be rotated and extended towards a second side of the infant's foot 340.

Teether 320 may be configured to be disposed on a top surface of the infant's foot so that teether 320 does not touch a surface of a floor when teether 320 is not being used by the infant as a teether. Teether 320 may also rotate from the first side of the infant's foot 330 to a second side of the infant's foot 340 so that the infant may have better access to teether 320. In embodiments, teether 320 may be positioned such that if teether 320 rotates from the first side of the infant's foot 330 to the second side of the infant's foot 340, teether 320 may not be positioned at a downward angle to touch a surface of the floor.

Figure 4:
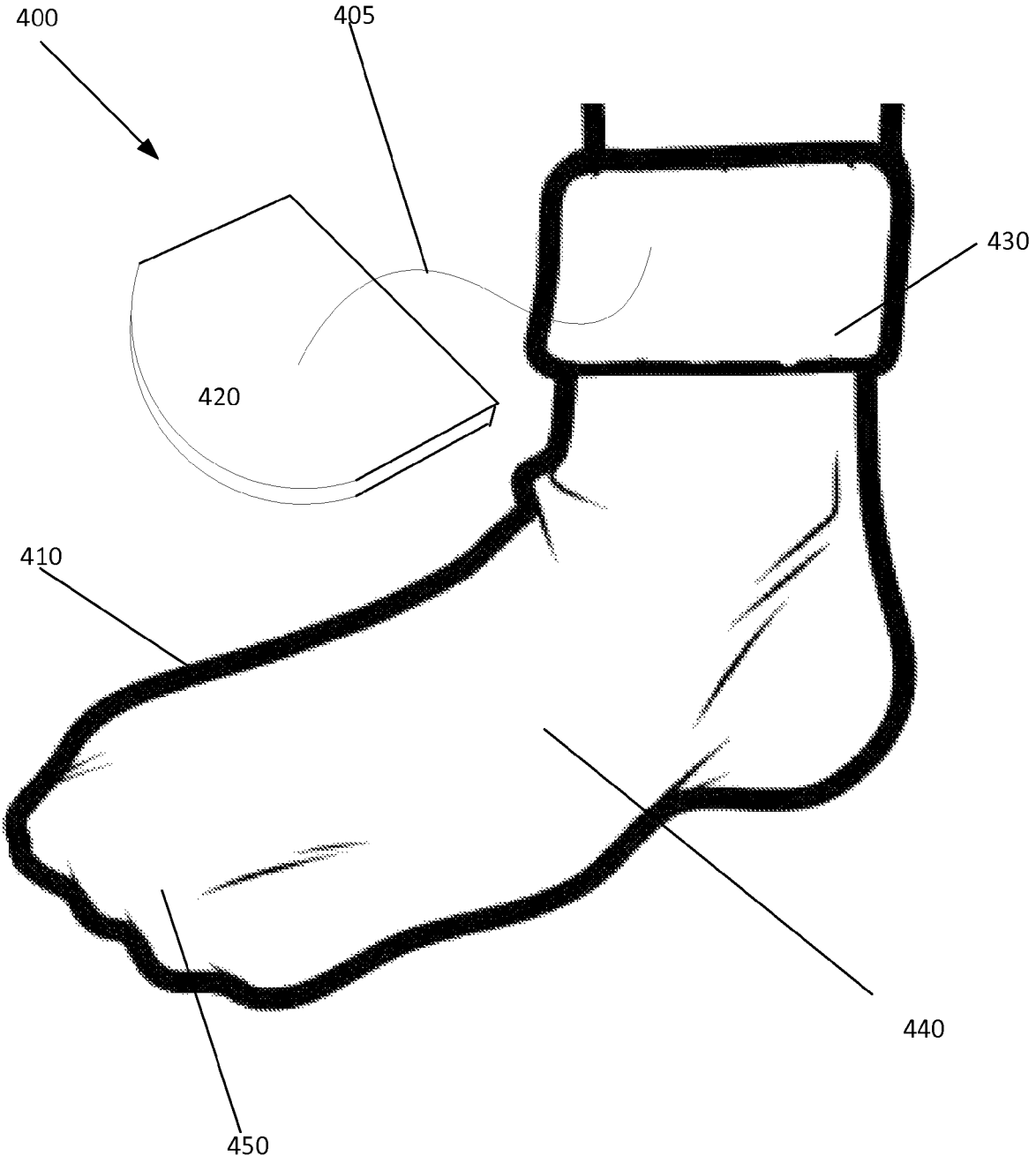
FIG. 4 depicts one embodiment of a teething device.

FIG. 4 depicts one embodiment of a teething device 400. Certain elements of teething device 400 are substantially the same as teething device 100, therefore for the sake of brevity another description of these elements is omitted.

Teething device 400 may include connector portion 405. Connector portion 405 may be a piece of material configured to couple sock 410 and teether 420. Connector portion 405 may be configured to dangle, swing, or sway teething device 420 from sock 410.

Connector portion 405 may be configured to be coupled to sock 410 at any position on the surface of sock 410, such as a top portion 430 is configured to be disposed around an infant's ankle, mid portion 440 configured to be disposed between an infant's ankle and toes, or a lower portion 450 configured to be disposed at an infant's toes. In one embodiment, connector portion 405 may be configured to be a length such that if connector portion 405 is coupled to top portion 430 of sock 410, then connector portion 405 and/or teether 420 will not extend to a surface of a floor or past the sole of the infant's foot.

Teether 420 may be configured to be coupled to connector portion 405 so that an infant may more easily access teether 420. Therefore, a less flexible infant may be able to use teether 420 coupled to sock 410. In one embodiment, connector portion 405 may be comprised of an elastic material such that connector portion 405 may be extended and then returned to its original length. As such, an infant may extend connector portion 405 so that teether 420 is positioned further away from sock 410, and connector portion 405 may return to its original length upon the infant releasing teether 420.

Figure 5:
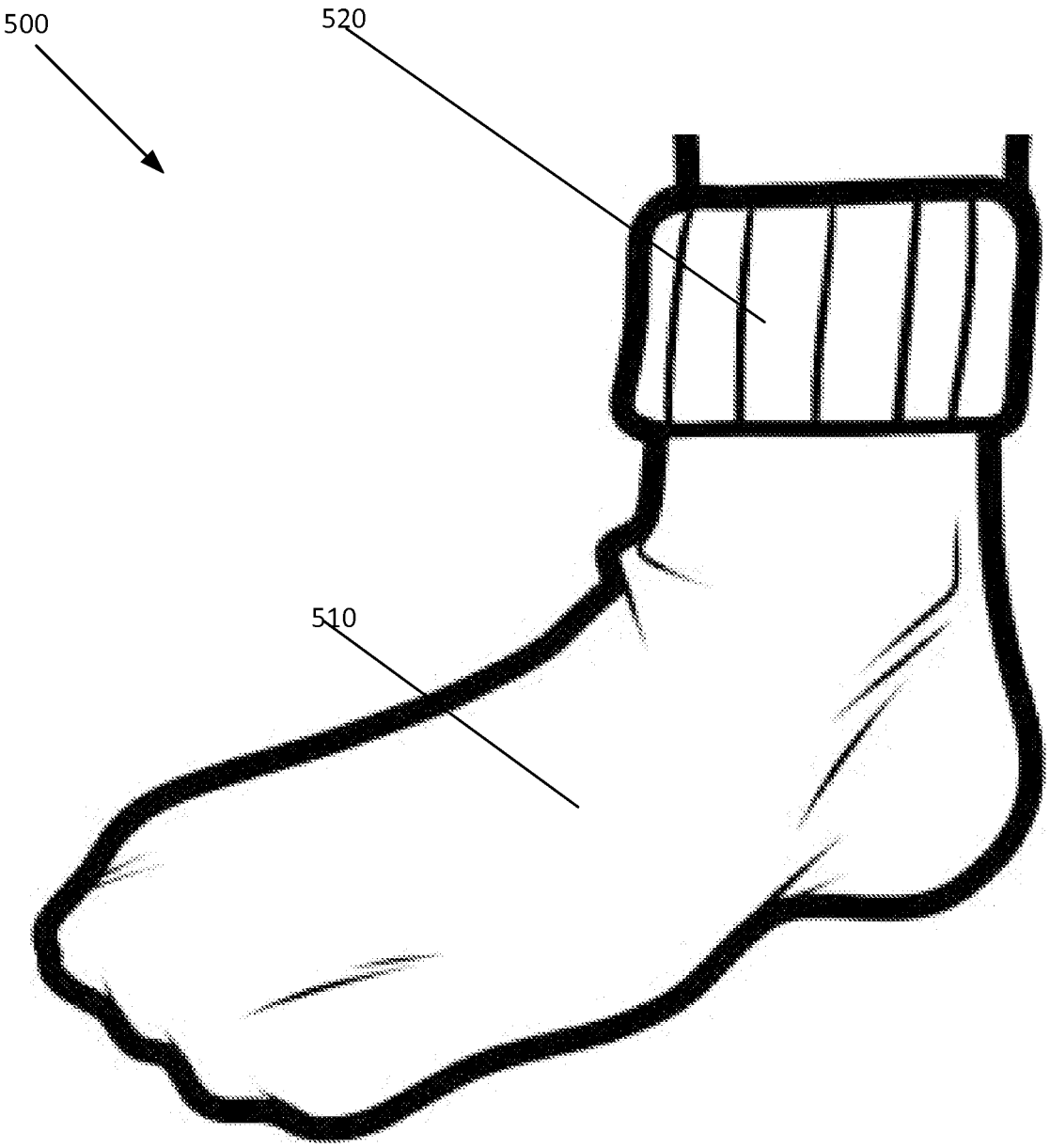
FIG. 5 depicts one embodiment of a teething device.

FIG. 5 depicts one embodiment of a teething device 500. Certain elements of teething device 500 are substantially the same as teething device 100, therefore for the sake of brevity another description of these elements is omitted.

Teething device 500 may include sock 510 and teether 520. Teether 520 may be configured to be fixedly or removably attached to sock 510.

Teether 520 may be configured to be coupled to an upper portion of sock 510 so that teether 520 may be rotated from a first position, where teether 520 is an extension of sock 510 to a second position, where teether 520 is positioned on top of an outer surface of sock 510. One skilled in the art will appreciate that teether 520 may also be configured to be aligned in a fixed position at any angle between the first position and the second position. For example, in one embodiment, teether 520 may be configured to be aligned at a slightly downward angle so that teether 520 projects away from the infant's ankle.

Teether 520 may have a length that is shorter than the height of sock 510 so that if teether 520 is in the second position teether 520 will not extend onto the floor or past the infant's heel.

In one embodiment, teether 520 may have a ruffled outer circumference and/or any other design. Teether 520 may have an inner circumference configured to encompass an infant's entire ankle or encompass only a portion of the infant's ankle, such that teether 520 may be a projection or flap.

Figure 6:
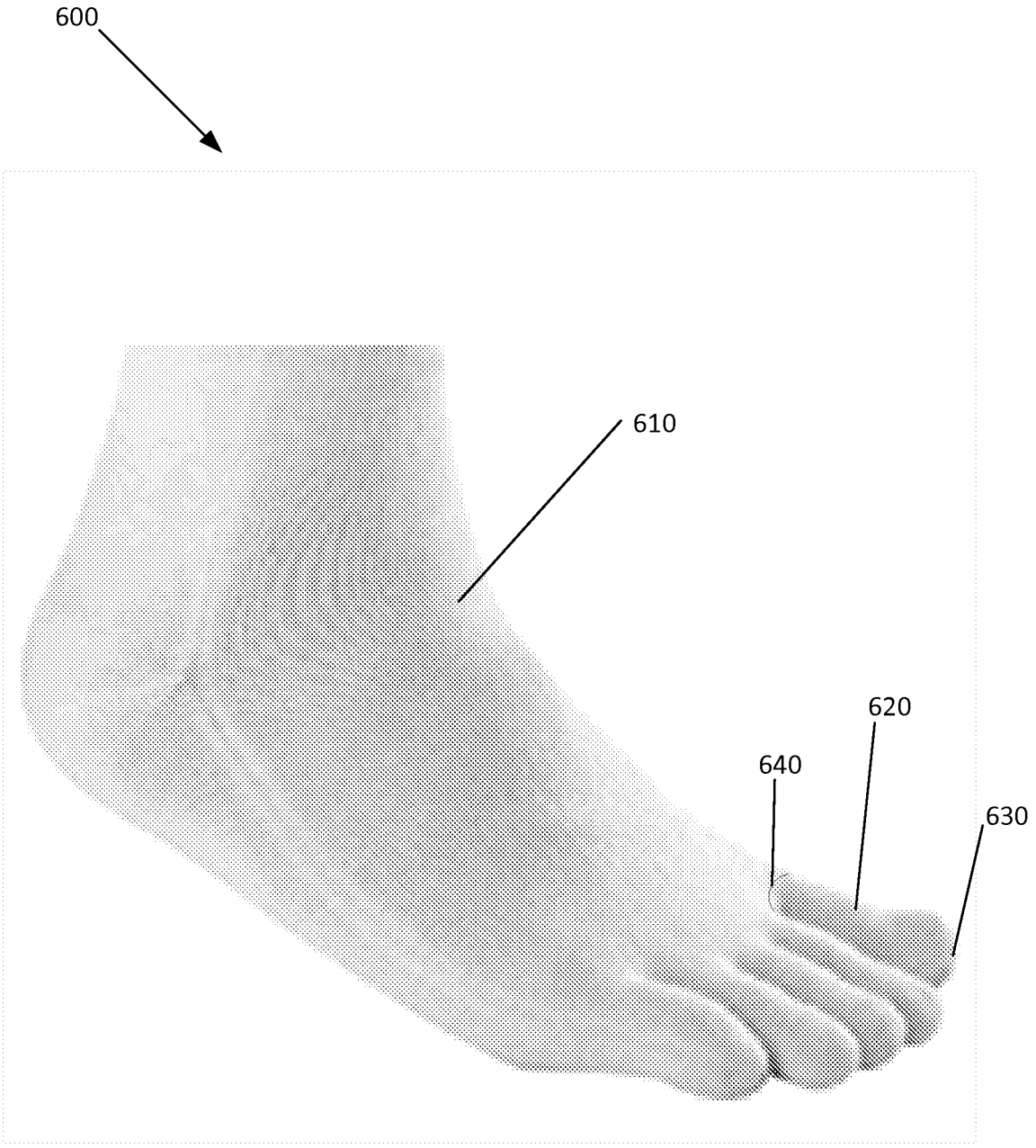
FIG. 6 depicts one embodiment of a teething device.

FIG. 6 depicts one embodiment of a teething device 600. Certain elements of teething device 600 are substantially the same as teething device 100, therefore for the sake of brevity another description of these elements is omitted.

Sock 610 may be a toe sock where each toe is individually encased by fabric.

Teether 620 may individually encase at least one of the infant's toes, and extend from a tip of the infant's toe 630 to a cuneiform bone 640 to encase one of an infant's toes. Teether 620 may be configured such that an infant may replicate chewing, biting, etc. on one of their toes.

Teether 620 may include bumps, ridges, indentions, projections, insertions, etc. In one embodiment, each of infant's toes may be encased by a teether with a different shape and/or size.

In other embodiments, teether 620 may not fully encase an infant's toe, but may instead encase or cover only a portion of the infant's toe, such as a top surface of the infant's toe. One skilled in the art will appreciate that teether 620 may be fixedly or removably attached to sock 610, and in other embodiments a plurality or each of the infant's toes may have a teether encasing a respective toe.

Figure 7:
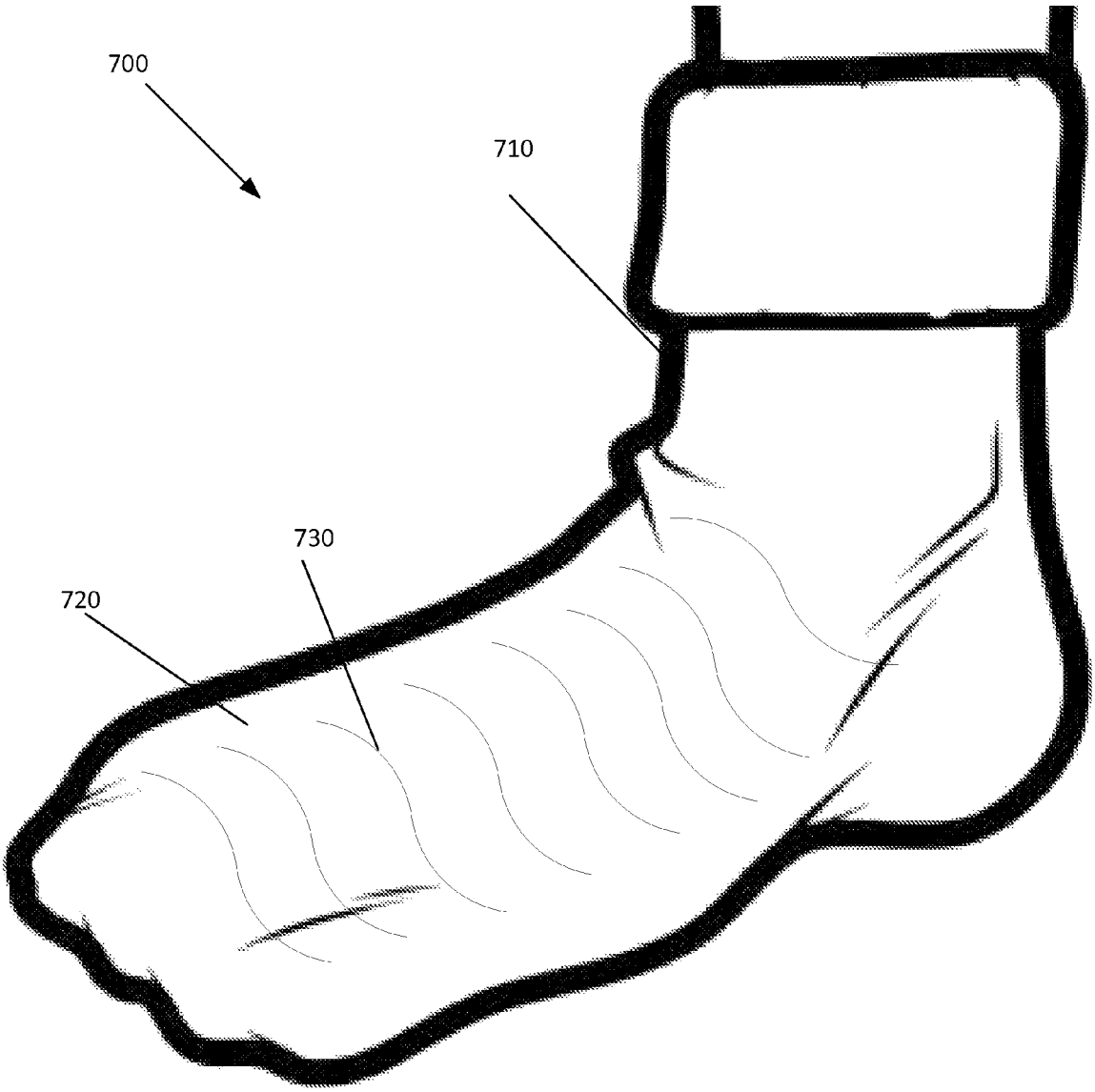
FIG. 7 depicts one embodiment of a teething device.

FIG. 7 depicts one embodiment of a teething device 700. Certain elements of teething device 700 are substantially the same as teething device 100, therefore for the sake of brevity another description of these elements is omitted.

In one embodiment, a surface 720 of sock 710 may include layer a teething material 730 covering at least a portion of sock 710.

Teething material 730 may be any material suitable for a teether as discussed above, and may be a different material than that of sock 710. Teething material 730 may also include at least one pattern, ridge, projection, bump, indention or a combination of patterns, ridges, projections, bumps, indentions, etc.

In one embodiment, material 730 may be positioned adjacent to or on top of sock 710 so that material 730 is a layer disposed on sock 710. In an embodiment, teething material 730 may be a layer configured to cover sock 710 including the ankle portion, heal, sole, toe, and foot portion. In other embodiment teething material 730 may be a layer configured to cover only a portion of sock 710, such as only an ankle, heal, sole, toe and/or foot portion.

One skilled in the art will appreciate that instead of teething material 730 being a layer disposed on top of sock 710, in one embodiment teething material may be used as the fabric or material for the sock. Therefore, an inner surface of teething material 730 may be configured to contact an infant's foot.

Figure 8:
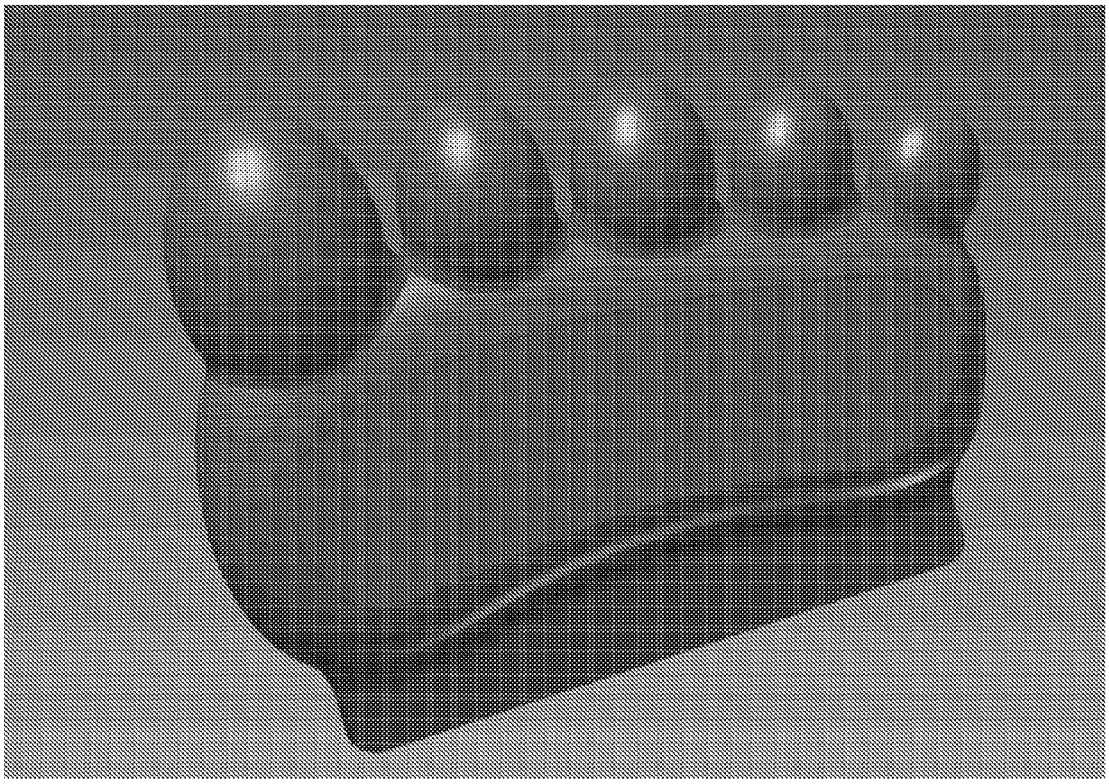
FIG. 8 depicts one embodiment of a teether that may be coupled to a teething device.

FIG. 8 depicts one embodiment of a teether 800. Teether 800 may be used in place of teether 120, 220, 320, 420, or 520. Therefore, for the sake of brevity another description of these elements is omitted.

Teether 800 may include a plurality of projections configured to represent a child's toes. The plurality of projections may extend away from a base configured to represent the ball of a child's foot. As such, teether 800 may be shaped and/or sized to represent the child's foot and toes. A child may use teether 800, while teether 800 is an independent device or coupled to an article of clothing covering the child's foot.

In embodiments, teether 800 may be shaped and size, and disposed at a position of an article of clothing such that a child may simulate teething on their toes with teether 800.

In the foregoing specification, embodiments have been described with reference to specific embodiments. However, one of ordinary skill in the art appreciates that various modifications and changes can be made without departing from the scope of the invention. Accordingly, the specification and figures are to be regarded in an illustrative rather than a restrictive sense, and all such modifications are intended to be included within the scope of the invention.

Although the invention has been described with respect to specific embodiments thereof, these embodiments are merely illustrative, and are thus not restrictive of the invention. The description herein of illustrated embodiments of the invention is not intended to be exhaustive or to limit the invention to the precise forms disclosed herein (in particular, the inclusion of any particular embodiment, feature, or function is not intended to limit the scope of the invention to such embodiment, feature, or function).

Rather, the description is intended to describe illustrative embodiments, features and functions in order to provide a person of ordinary skill in the art context to understand the invention without limiting the invention to any particularly described embodiment, feature, or function. While specific embodiments of, and examples for, the invention are described herein for illustrative purposes only, various equivalent modifications are possible within the spirit and scope of the invention, as those skilled in the relevant art will recognize and appreciate.

As indicated, these modifications may be made to the invention in light of the foregoing description of illustrated embodiments of the invention and are to be included within the spirit and scope of the invention. Thus, while the invention has been described herein with reference to particular embodiments thereof, a latitude of modification, various changes, and substitutions are intended in the foregoing disclosures. It will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the invention.

Reference throughout this specification to "one embodiment," "an embodiment," "a specific embodiment" or similar terminology means that a particular feature, structure, or characteristic described in connection with the embodiment is included in at least one embodiment and may not necessarily be present in all embodiments. Thus, respective appearances of the phrases "in one embodiment," "in an embodiment," or "in a specific embodiment" or similar terminology in various places throughout this specification are not necessarily referring to the same embodiment.

Furthermore, the particular features, structures, or characteristics of any particular embodiment may be combined in any suitable manner with one or more other embodiments. It is to be understood that other variations and modifications of the embodiments described and illustrated herein are possible in light of the teachings herein and are to be considered as part of the spirit and scope of the invention.

In the description herein, numerous specific details are provided, such as examples of components and/or methods, to provide a thorough understanding of embodiments of the invention. One skilled in the relevant art will recognize, however, that an embodiment may be able to be practiced without one or more of the specific details, or with other apparatus, systems, assemblies, methods, components, materials, parts, and/or the like. In other instances, well-known structures, components, systems, materials, or operations are not specifically shown or described in detail to avoid obscuring aspects of embodiments of the invention. While the invention may be illustrated by using a particular embodiment, this is not and does not limit the invention to any particular embodiment and a person of ordinary skill in the art will recognize that additional embodiments are readily understandable and are a part of this invention.

It will also be appreciated that one or more of the elements depicted in the drawings/figures can also be implemented in a more separated or integrated manner, or even removed or rendered as inoperable in certain cases, as is useful in accordance with a particular application. Additionally, any signal arrows in the drawings/figures should be considered only as exemplary, and not limiting, unless otherwise specifically noted.

Furthermore, the term "or" as used herein is generally intended to mean "and/or" unless otherwise indicated. As used herein, a term preceded by "a" or "an" (and "the" when antecedent basis is "a" or "an") includes both singular and plural of such term (i.e., that the reference "a" or "an" clearly indicates only the singular or only the plural). Also, as used in the description herein, the meaning of "in" includes "in" and "on" unless the context clearly dictates otherwise.

Benefits, other advantages, and solutions to problems have been described above with regard to specific embodiments. However, the benefits, advantages, solutions to problems, and any component(s) that may cause any benefit, advantage, or solution to occur or become more pronounced are not to be construed as a critical, required, or essential feature or component.

What is claimed is:

1. A method comprising:

covering an infant's foot and toes with an article of clothing, wherein the article of clothing includes a single opening;

coupling a teether across an upper surface of the article of clothing without forming a second opening in the article of clothing;

rotating the teether between a first position and a second position, wherein in the first position a first portion of the teether is positioned over a first area of the article of clothing that covers toes of the infant and in the second position the first portion of the teether is positioned proximate to an ankle of the infant over a second area of the article of clothing, wherein the teether does not touch a floor surface and does extend beyond the toes in either the first position or the second position; and inserting the teething device into a mouth of the infant when the teether is in the first position or the second position.

2. The method of claim 1, wherein the article of clothing is one of a sock or bootee.

3. The method of claim 1, further comprising:

coupling the teether to the article of clothing across a tip of the toes, extending the teether in a direction outward from the toes, and rotating the teether from the first position to the second position.

4. The method of claim 3, wherein when the teether rotates from the second position to the first position, the teether is configured to not extend past the toes and does not touch a floor surface.

5. The method of claim 1, further comprising:

removing the teether from the article of clothing.

6. The method of claim 1, further comprising:

fixedly coupling the teether to the article of clothing.

7. The method of claim 1, wherein when the teether is uncoupled from the article of clothing, the article of clothing only includes the single opening.

8. The teething device of claim 1, wherein the teether comprises a different material than the article of clothing.

* * * * *